United States Patent [19]

Hensley et al.

[11] 4,333,126

[45] Jun. 1, 1982

[54] COMBUSTION INITIATION DEVICE

[76] Inventors: George H. Hensley, Star Rte. Box 150L, Alameda, N. Mex. 87114; Raymond E. Hensley, 3805 Garcia Northeast, Albuquerque, N. Mex. 87111

[21] Appl. No.: 154,959

[22] Filed: May 30, 1980

[51] Int. Cl.[3] ..... H01T 13/00

[52] U.S. Cl. ..... 361/257; 313/138; 313/141

[58] Field of Search ..... 313/118, 138, 139, 141; 123/169 R, 169 EL; 361/257

[56] References Cited

U.S. PATENT DOCUMENTS

| | | | |
|---|---|---|---|
| 1,119,674 | 12/1914 | Besson | 313/138 |
| 1,425,329 | 8/1922 | Mellblom | 313/138 |
| 2,096,250 | 10/1937 | Kasarjian | 123/169 EL |

FOREIGN PATENT DOCUMENTS

| | | | |
|---|---|---|---|
| 2739413 | 3/1979 | Fed. Rep. of Germany | 123/169 R |

*Primary Examiner*—C. C. Shaw

*Attorney, Agent, or Firm*—Krass, Young & Schivley

[57] ABSTRACT

A device for initiating combustion of fuels produces a high energy plasma jet by rapidly transferring energy from a capacitive section thereof to an electrode section integral therewith. A plurality of circular capacitor plates disposed in parallel, spaced relationship to each other within an electrically conductive, cylindrical casing filled with dielectric fluid form the capacitive section. The capacitor plates are alternately connected to the casing and to an elongate rod which extends longitudinally through the casing. One end of the rod extends outwardly from an end of the casing and includes a circularly shaped, pointed firing tip which is spaced from the end of the casing and defines one electrode of the device. The end of the casing surrounding the shaft defines the other electrode such that the initial discharge between the electrodes is in the form of a cylindrical sheet. The cylindrical sheet discharge is quickly transformed into a plasma jet by magnetic fields.

23 Claims, 5 Drawing Figures

COMBUSTION INITIATION DEVICE

TECHNICAL FIELD

This invention generally deals with fuel combustion systems and deals more particularly with a device for producing a high energy plasma jet useful in initiating fuel combustion.

BACKGROUND ART

Conventional spark plugs have, for some time, been employed for initiating combustion of fuels, particularly in internal combustion engines. Numerous attempts have been made in the past to increase the energy output of these spark plugs since it was known that these devices were relatively inefficient in maximizing the combustion of a given amount of fuel. A more thorough discussion of prior art attempts at increasing combustion efficiency may be found in copending U.S. application entitled "Combustion Initiation System", Ser. No. 119,869, filed Feb. 8, 1980, the entire disclosure of which is hereby incorporated by reference herein. As described in said co-pending application mentioned above, one successful solution to the problem consists of employing a device for initiating combustion of fuel which creates a combustion initiating plasma jet having an energy density which approaches the energy density resulting from the combustion of the fuel itself.

Several forms of an initiation device capable of producing a plasma jet having a desired high energy density level are described in the co-pending application identified above; these devices, while entirely suitable for their intended purpose, were limited however, in terms of the maximum amount of energy that could be delivered during discharge thereof.

Accordingly, it is an important object of the present invention to provide a device for producing a high energy plasma jet useful in initiating the combustion of fuels, which is capable of delivering a plasma jet capable of delivering greater energy than was heretofor possible.

Another object of the present invention is to provide a device of the type mentioned above which is compact in overall size in relation to the energy density of the discharge which it is capable of producing.

A further object of the invention, related to the foregoing object, is to provide a device of the type mentioned which includes a capacitor portion capable of storing a maximum amount of electrical energy in a minimum amount of volume.

A still further object of the present invention is to provide a device as described above which is self-cleaning of the products of combustion and therefore avoids becoming fouled with such products.

A further object of the invention is to provide an initiation device as described above which is suitably configured for use in conventional, existing internal combustion engines, without the need for significant modification of the structural components of such engines.

These and further objects of the invention will be made clear or will become apparent during the following description.

DISCLOSURE OF THE INVENTION

In accordance with the present invention, a device for initiating combustion of fuels produces a high energy plasma jet by rapidly transferring energy from a capacitive section thereof to an electrode section integral with the capacitive section. A plurality of circular capacitor plates are disposed in parallel, spaced relationship to each other within an electrically conductive, cylindrically shaped casing filled with dielectric material. The capacitor plates are alternately connected to the casing and an elongate rod respectively, which rod extends longitudinally through the casing. One end of the shaft extends outwardly beyond one end of the casing and includes a circularly shaped, pointed firing tip which is spaced from the casing and defines one electrode of the device. The end of the casing surrounding the rod defines the other electrode such that the initial discharge between the electrodes is in the form of a cylindrical sheet. The plasma jet is developed using the inverse pinch technique.

BRIEF DESCRIPTION OF THE DRAWINGS

In the drawings, which form an integral part of the specification and are to be read in conjunction therewith, and in which like components are designated by identical reference numerals in the various views.

BEST MODE FOR CARRYING OUT THE INVENTION

Figure 1:
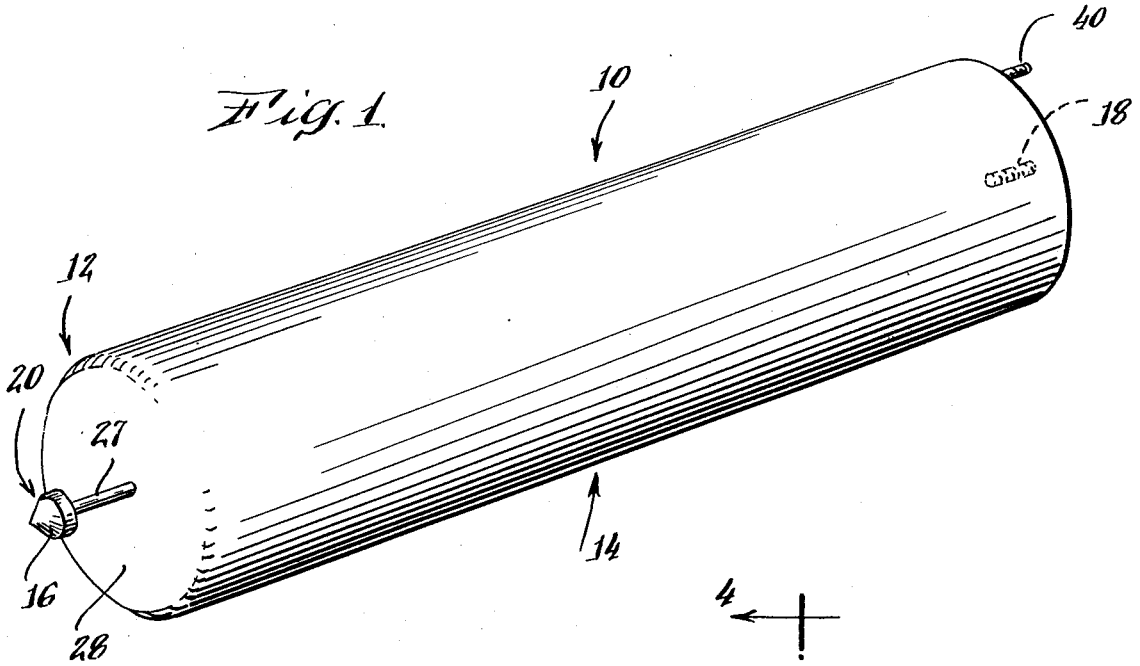
FIG. 1 is a perspective view of a combustion initiation device which forms the preferred embodiment of the present invention.
Figure 2:
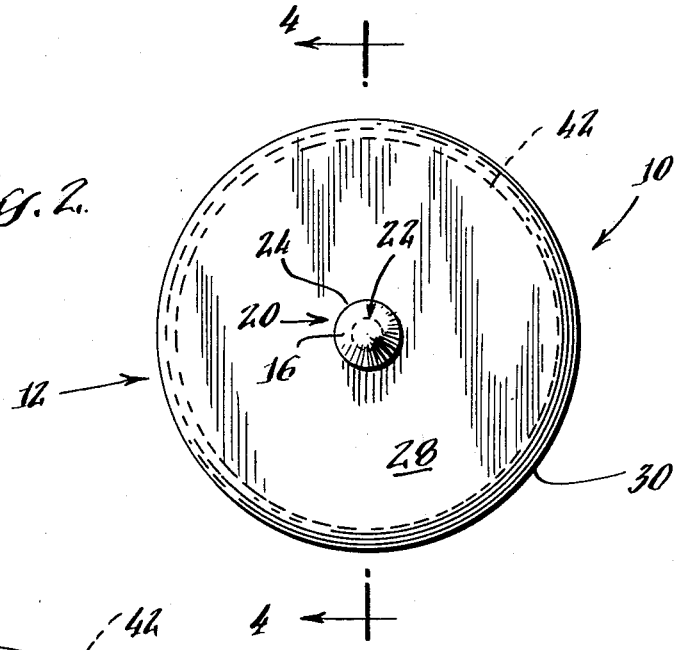
FIG. 2 is an elevational view of one end of the device shown in FIG. 1.
Figure 3:
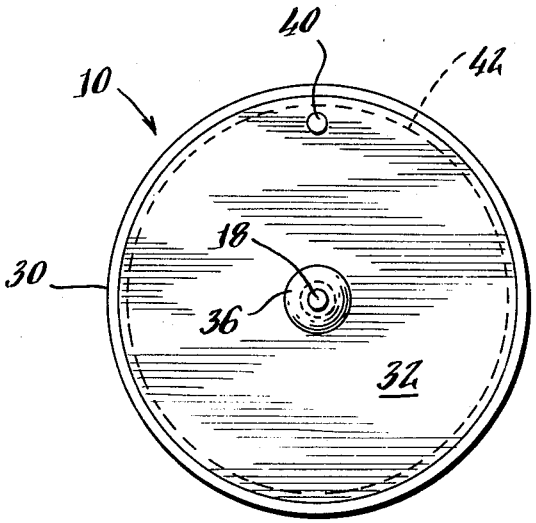
FIG. 3 is an elevational view of the other end of the device shown in FIG. 1.

Referring now to the drawings, a combustion initiation device 10 includes an electrode portion on one end thereof, generally indicated by the numeral 12, and a capacitive portion 14. The electrode portion 12 includes a first electrode 16 defined on one end of an electrically conductive, rod shaped member 18 which is circular in cross-section. The first electrode 16 is provided with a circularly shaped, pointed firing tip 20 secured to one end of a shank 27, which shank 27 forms an integral part of one extremity of member 18 and is of reduced diameter. Firing tip 20 includes a forwardly disposed, conically shaped surface 22 which is preferably inclined approximately 60° with respect to the longitudinal axis of member 18. The tip 20 has a cylindrically shaped outer skirt 24 extending rearwardly from the surface 22 and is provided with a concave, relieved area 26 on the rear face thereof circumscribing the member 18. The firing tip 20 may be formed integral with the shank 27, as by casting or machining.

The electrode portion 12 further includes a second electrode 28 longitudinally spaced from the firing tip 20 and circumscribing the shank 27. Electrode 28 is circular in shape and forms one end of a housing or casing 30. Electrode 28 may be formed integral with the circumferential side wall of casing 30 and the forward outer surface thereof is substantially flat. A circularly shaped end wall 32 is suitably joined to the other end of casing 30 such that the end wall 32 is electrically connected to the circumferential side wall of casing 30 as well as to the second electrode 28. Such connection may be effected by soldering if desired, using a high temperature silver solder. In any event, the resulting seal between the end wall 32 and circumferential side wall of the casing 30 should be fluid right in order that the casing 30 provides a fluid tight enclosure. The casing 30, including end wall 32 and the second electrode 28, is formed of electrically conductive material having a low resistance, such as copper.

Figure 4:
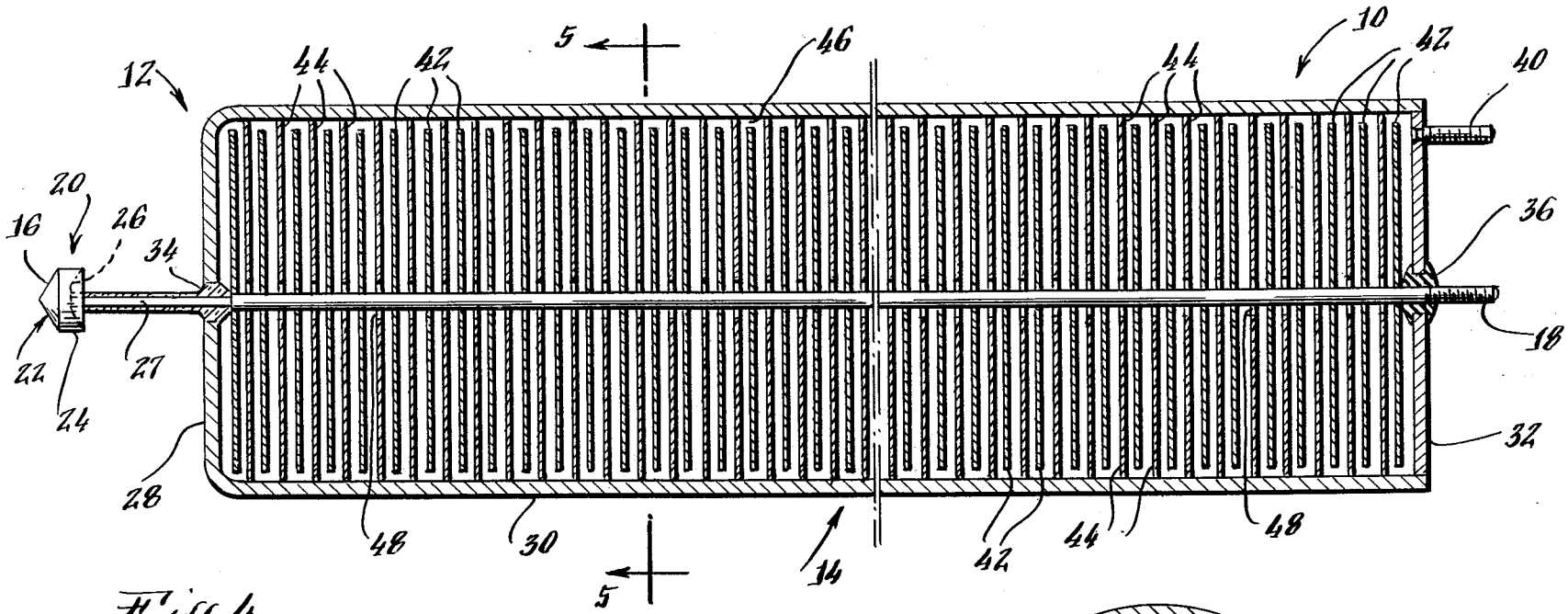
FIG. 4 is a sectional view taken along the line 4—4 in FIG. 2.
Figure 5:
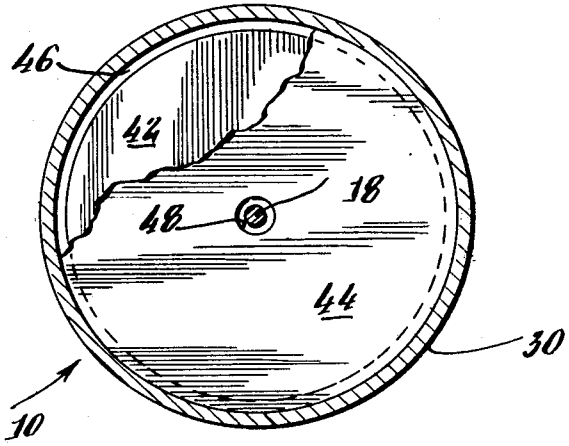
FIG. 5 is a sectional view taken along the line 5—5 in FIG. 4, parts of one capacitor plate being broken away to reveal an adjacent capacitor plate.

The rod shaped member 18 extends longitudinally through the casing 30 and through axially aligned apertures in the second electrode 28 and end wall 32. A pair of electrically insulated sleeves 34 and 36 support the rod shaped member 18 within the apertures of the electrode 28 and end wall 32 so as to electrically insulate the member 18 from the casing 30. Insulative sleeve 34 is preferably formed of a material such as glass or ceramic, capable of withstanding relatively high combustion temperatures. Sleeve 34 also extends forwardly from electrode 28 to the concave surface 26 and completely around the shank 27 in order to provide an electrically insulative covering over the outside surface of shank 27. Sleeve 36 may be formed of rubber if desired and, as shown in FIG. 4, comprises a grommet captively held by the end wall 32. Both sleeves 34 and 36 also provide a fluid tight seal between the rod shaped member 18 and the casing 30.

In some cases, it may be necessary to provide the rod shaped member 18 with a bore extending longitudinally through a portion thereof between the firing tip 20 and second electrode 28 in order to accomodate variations in the coefficient of thermal expansion between the material of member 18 and the material of sleeve 34. The extremity of member 18 adjacent the end wall 32 may be threaded or otherwise adapted to form a terminal suitable for connecting with a source of electrical energy. A threaded stud 40 may be secured to the end wall 32, as by welding, to provide a second electrical terminal for the casing 30. Although not specifically shown in the drawings, the circumferential side wall of the casing 30 may be threaded, if desired, in order to secure the device 10 in operative relationship to a fuel chamber, such as in the block of a conventional, internal combustion engine.

The capacitive portion 14 comprises a first and second plurality of circularly shaped, longitudinally spaced, alternately disposed electrical capacitor plates, each respectively designated by the numerals 42 and 44. Each of the plates 42 is provided with an aperture centrally therein through which the rod shaped member 18 is received. Each of the plates 42 is secured to the member 18 around the apertures therein in a manner which electrically connects such plate to the member 18. Plates 42 are of uniform diameter which is less in magnitude than that of the inside diameter of casing 30 such that the entire periphery of each plate is radially spaced from the interior side wall of casing 30, as at 46.

The second plurality of plates 44 are also of a uniform diameter which is essentially equal to that of the inside diameter of casing 30. At least portions of the circumferential periphery of the plates 44 are secured by welding, brazing or soldering to the interior side wall of the casing 30. Each of the plates 44 is provided with an aperture 48 centrally therein which is of larger diameter than that of the member 18 such that marginal areas of each plate 44 defining the aperture of 48 is radially spaced (and therefore electrically insulated) from the rod shaped member 18. From the foregoing, it is apparent that the first plurality of plates 42 is electrically connected to the rod shaped member 18 but are electrically insulated from both the casing 30 and the second plurality of plates 44. Also, the second plurality of plates 44 are each electrically connected to the casing 30, and are electrically insulated from both the rod shaped member 48 and first plurality of plates 42. The plates 42 and 44 form a plurality of capacitors; for example, each of the plates 42 is disposed in selectively spaced relationship between a pair of the capacitor plates 44. Likewise, each of the capacitor plates 44 is disposed between a pair of first capacitor plates 42. The spacing between the plates 42 and 44 is preferably uniform, and the magnitude of such spacing will be controlled by various parameters which will vary with the intended application, such as the overall size of the plates, a thickness of the plates, the magnitude of electrical power which is to be stored in the capacitive portion 14, the number of the plates 42 and 44 employed, etc. In any event, each of the plates 42 and 44 comprises, most desirably, an oxygen free type copper composition. It should be noted that each of the capacitor plates 42 and 44, as well as end wall 32, electrode 28, firing tip 20 and casing 30 are disposed concentric with respect to the longitudinal axis of member 18.

The entire casing 30 is filled with a dielectric material which forms a dielectric barrier between each of the pairs of capacitor plates 42 and 44. The dielectric material is preferably high in purity, typically on the order of 99.9 percent, to prevent polar ionization thereof which otherwise increases the conductivity of such material. The degree of purity, however, will be governed in part by the magnitude of spacing between the plates 42 and 44. Less distance between the plates 42 and 44 requires that the dielectric material be of greater purity, while greater spacing between the plates decreases the purity requirement for the dielectric material. The dielectric material may be in liquid or solid form. If the dielectric material is in liquid form and is to be subjected to weather conditions, such liquid should be one of a type resistant to freezing; ethylene glycol has been found to be suitable for use as the dielectric liquid when the device 10 is subjected to cold temperatures. In solid form, the dielectric material may comprise a powder or a series of individual wafer members.

The device 10 may be manufactured by first forming the rod shaped member 18, including the firing tip 20 by molding, casting or machining the same into the desired configuration. Next, the electrically insulative sleeve 34 is molded onto that portion of the member 18 between the firing tip 20 and the annularly shaped seat defined by the shank 27. The member 18 having the sleeve 34 molded thereon is then inserted through the casing 30 such that the sleeve 34 is disposed within the aperture formed in the second electrode 28, and the entire assembly is then baked at high temperature in order to bond the sleeve 34 to both the member 18 and second electrode 28. Next, the capacitor plates 42 and 44 are successively inserted into the open end of the casing 32 and are sleeved over the rod shaped member 18. The plates 42 and 44 are successively attached to the member 18 and casing 32, respectively. Dielectric material in either solid or liquid form may be added to the casing 30 as the plates 42 and 44 are being secured therewithin; alternately, the casing 30 may be filled with a fluid form of dielectric after the last plate has been secured within the casing, and in fact such fluid may be added even after the end wall 32 is secured to the casing 30 by directing the dielectric fluid through the aperture in the end wall before the sleeve 36 is installed.

In operation, the stud 40 and threaded extremity of the rod shaped member 18 are connected with a suitable source of high voltage electrical energy (not shown). Current flows through the stud 40, end wall 32, and cylindrical side wall of the casing 30 to the second plurality of plates 44, while current also flows through the rod shaped member 18 to each of the first plurality of capacitor plates 42, thereby creating a high electrical potential between the pairs of plates 42 and 44. As the electrical potential in the capacitive portion 14 increases, the electrical potential between the firing tip 20 and the second electrode 28 likewise increases, thereby ionizing the environment circumscribing the shank 27. When the magnitude of electrical potential stored in capacitive portion 14 reaches a predetermined level, discharge of the device 10 occurs; upon discharge, current flows from each of the first capacitor plates 42 through the rod shaped member 18 to the firing tip 20. A cylindrically shaped electrical discharge is then formed between the firing tip 20 and second electrode 28 which develops, as a result of magnetic pressures, into an umbrella shaped configuration and then into a plasma jet which is directed outwardly toward the fuel as described in co-pending application, U.S. Ser. No. 119,869. By virtue of the high energy densities produced during discharge of the device, in combination with the essentially flat surface provided by the second electrode 28, the products of combustion do not form on either electrode. Thus, the device 10 is self-cleaning and its efficiency does not degrade over a period of time due to foul-up as in prior art combustion initiation devices.

From the foregoing, it is apparent that the combustion initiation device described above not only provides for the reliable accomplishment of the objects of the invention but does so in a particularly simple and highly efficient manner. It is recognized, of course, that those skilled in the art may make various modifications or additions to the preferred embodiment chosen to illustrate the invention without departing from the spirit and scope of the present contribution to the art. For example, several of the conductive paths, such as that provided by the circumferential side wall of the casing 30, may be constructed using thin film techniques. Accordingly, it is to be understood that the protection sought and to be afforded hereby should be deemed to extend to the subject matter claimed and all equivalents thereof fairly within the scope of the invention.

Having thus described the invention, what is claimed is:

1. A device for generating a high energy plasma jet for use in initiating combustion of fuel, comprising:

a first electrical electrode including a rod shaped member having a firing tip on one end thereof;

a second electrode electrically insulated from said first electrode and circumscribing the longitudinal axis of said rod shaped member, said first and second electrodes defining a discharge gap across which electrical energy may be discharged in an annular pattern, said tip being longitudinally spaced from said second electrode a sufficient distance to allow the annular discharge to generate a generally cylindrical electromagnetic field surrounding said discharge and sufficient in strength to temporarily radially confine said discharge; and, a capacitive portion including a first and second plurality of spaced apart capacitive elements alternately disposed with respect to each other and respectively connected to said first and second electrodes.

2. The device of claim 1, wherein: said first plurality of capacitive elements comprise plate members each connected to said rod shaped member and symmetrically disposed about said longitudinal axis, and said second plurality of capacitive elements are electrically connected with each other.

3. The device of claim 2, wherein each of said first and second plurality of capacitive elements is essentially circular in shape.

4. The device of claim 2, including a casing enclosing each of said first and second plurality of capacitive elements, said first and second plurality of capacitive elements extending essentially parallel to each other.

5. The device of claim 4, including a dielectric material within said casing and between said first and second plurality of capacitive elements.

6. The device of claim 5, wherein said dielectric material comprises ethylene glycol.

7. The device of claim 4, wherein:

the outer periphery of each of elements of said first plurality of said capacitive elements is spaced from said casing, and each of the capacitive elements in said second plurality thereof is provided with an aperture therein through which said rod member extends, the inner periphery of said last named capacitive elements defining said apertures therein being radially spaced from said rod member.

8. The device of claim 1, wherein:

said rod shaped member is provided with a layer of electrically insulative material therearound extending between said firing tip and said second electrode, and said firing tip is essentially circular in cross-section.

9. The device of claim 1, including a casing enclosing each of said first and second plurality of capacitive elements, said casing being electrically connected with said second electrode and with each of second plurality of capacitive elements, each of said first plurality of capacitive elements being electrically connected with said rod member and spaced from said casing.

10. The device of claim 9, including first and second terminal means respectively connected with said casing and with said rod shaped member for connecting said capacitive portion with a source of electrical power.

11. A device for converting electrical energy into a high energy plasma discharge employed to initiate combustion of fuel, comprising:

a first electrode;

a second electrode circumscribing a reference axis extending through said first electrode and spaced from said first electrode along said reference axis to define a ring shaped cylindrical space between said first and second electrodes across which electrical current may pass during discharge of said device to produce said high energy plasma, said first and second electrodes being spaced apart along said reference axis a sufficient distance to allow the discharge of electrical current between said electrodes to generate an electromagnetic field surrounding said discharge and temporarily radially confining said discharge;

a housing adjacent said first and second electrodes; and capacitive means electrically connected with said first and second electrodes and adapted to be coupled with a source of electrical energy for temporarily storing a quantity of electrical energy derived from said electrical energy source prior to delivery of said quantity of electrical energy to said first and second electrodes during discharge of said device, said capacitive means including a plurality of capacitor plates disposed in side-by-side spaced relationship to each other within said housing and alternately electrically connected to said first and second electrodes.

12. The device of claim 11, wherein said first electrode comprises a rod shaped member extending coaxial with said reference axis and having a circularly shaped firing tip on one end thereof adjacent said second electrode, alternate ones of said plurality of said capacitor plates being secured to said rod shaped member, the remaining capacitor plates of said plurality thereof being secured to said housing.

13. The device of claim 12, wherein:

said housing is generally cylindrical in shape and comprises an electrically conductive material, said second electrode is circular in shape and is secured to one end of said housing in a manner to close said one end of said housing, and said rod shaped member extends longitudinally through said housing and is secured to said housing in electrically insulated relationship to said housing.

14. The device of claim 13, wherein:

each of said plurality of capacitor plates is disposed symmetrical about said reference axis and is generally circular in shape, said alternate ones of said capacitor plates having the outer circumferential periphery thereof radially spaced from the interior circumferential side wall of said housing, said remaining capacitor plates each being provided with an aperture centrally disposed therein, marginal areas of each of said remaining capacitor plates defining said apertures therein being radially spaced from said rod shaped member.

15. The device of claim 13, wherein:

the other end of said housing is closed to provide a fluid tight enclosure surrounding said plurality of capacitor plates, and said device further includes a dielectric material within said housing and between said plurality of capacitor plates.

16. The device of claim 15, wherein said dielectric material comprises ethylene glycol.

17. The device of claim 13, including first and second electrical terminal means respectively defined on said housing and said rod shaped member for connecting said device to said source of electrical energy.

18. The device of claim 13, wherein said second electrode is formed integral with said housing.

19. The device of claim 13, including means for mounting said rod shaped member on said housing in electrically insulated relationship to said housing.

20. The device of claim 12, wherein said rod shaped member is provided with a layer of electrically insulative material therearound and extending between said firing tip and said second electrode.

21. The device of claim 12, wherein a section of said rod shaped member extending between said firing tip and said second electrode includes a longitudinal bore therewithin.

22. The device of claim 13, wherein the exterior circumferential sidewall of said housing is provided with a thread form therein.

23. The device of claim 11, wherein each of said capacitive plates comprises copper material.

* * * * *